US009756417B1

(12) United States Patent
Schnell

(10) Patent No.: US 9,756,417 B1
(45) Date of Patent: Sep. 5, 2017

(54) GAME CALL SPEAKER SYSTEM

(71) Applicant: IP Holdings, Inc., Fort Worth, TX (US)

(72) Inventor: Timothy D. Schnell, Rancho Santa Fe, CA (US)

(73) Assignee: IP HOLDINGS, INC., Forth Worth, TX (US)

( * ) Notice: Subject to any disclaimer, the term of this patent is extended or adjusted under 35 U.S.C. 154(b) by 9 days.

(21) Appl. No.: 14/528,974

(22) Filed: Oct. 30, 2014

Related U.S. Application Data

(63) Continuation-in-part of application No. 29/478,385, filed on Jan. 3, 2014.

(60) Provisional application No. 61/923,568, filed on Jan. 3, 2014.

(51) Int. Cl.
*H04R 25/00* (2006.01)
*H04R 1/32* (2006.01)

(52) U.S. Cl.
CPC ..... *H04R 1/323* (2013.01); *H04R 2201/40* (2013.01)

(58) Field of Classification Search
CPC .. A01M 31/004; A01M 31/06; A01M 31/002; A01M 31/008; H04R 2499/11; H04R 2499/15; H04R 1/323; H04R 2201/40
USPC ..... 381/387, 309, 388; 340/573.2; 206/315.11; 42/90
See application file for complete search history.

(56) References Cited

U.S. PATENT DOCUMENTS 5,464,054 A * 11/1995 Hinshaw ..... H01L 23/4093 165/185
D368,937 S 4/1996 Aker et al.
5,802,197 A * 9/1998 Fulcher ..... H04R 1/021 381/386
5,838,537 A * 11/1998 Lundgren ..... G06F 1/1616 361/679.27
5,926,168 A * 7/1999 Fan ..... G06F 3/0325 345/158
D425,508 S 5/2000 Fiebel et al.
6,414,906 B1 * 7/2002 Gaspari ..... A01M 31/004 340/384.7
D530,310 S * 10/2006 Tsai ..... D14/214
(Continued)

OTHER PUBLICATIONS www.cabelas.com, "Cabela's—Western Rivers Nite Stalker Pro Combo—customer reviews—product reviews", earlist date referenced in document is Jan. 17, 2012; obtained and printed on Oct. 31, 2014.

(Continued)

*Primary Examiner* — Davetta W Goins
*Assistant Examiner* — Phylesha Dabney
(74) *Attorney, Agent, or Firm* — Knobbe Martens Olson & Bear LLP

(57) ABSTRACT

Methods and devices are disclosed for attracting animals. A game call speaker system having a body portion, first speaker unit configured to rotate about a first axis, a second speaker unit configured to rotate about a second axis and a memory comprising one or more stored game calls is provided. Rotation of the first speaker unit may be independent of rotation of the second speaker unit. The first axis may be substantially parallel to the second axis. In some embodiments, the game call speaker system is configured to emit the stored game calls over a relatively wide angle (e.g., 360 degrees) relative to the body portion.

17 Claims, 8 Drawing Sheets

(56) References Cited

U.S. PATENT DOCUMENTS

| | | | | |
|---|---|---|---|---|
| D538,782 | S | 3/2007 | Ishibashi | |
| D556,737 | S | 12/2007 | Oh | |
| 7,606,605 | B2 * | 10/2009 | Lee | H04M 1/0247 455/575.3 |
| D632,279 | S | 2/2011 | Chow | |
| 8,186,339 | B1 * | 5/2012 | McClanahan | F41B 5/1434 124/86 |
| 9,439,413 | B2 * | 9/2016 | Peoples | A01M 31/06 |
| D769,211 | S | 10/2016 | Schnell | |
| 2003/0063765 | A1 * | 4/2003 | Lu | G06F 1/1605 381/333 |
| 2011/0113672 | A1 * | 5/2011 | Holmberg | A01M 31/06 43/2 |
| 2016/0021454 | A1 * | 1/2016 | Liang | H04R 1/403 381/333 |

OTHER PUBLICATIONS www.cabelas.com, "Primos Alpha Dogg Electronic Call: Cabela's", earliest date referenced in document is Oct. 16, 2014, obtained and printed Oct. 31, 2014.

www.amazon.com, "Maestro Game Calls Western Rivers Apache Pro Electronic Predator Caller", earliest date referenced in document is May 6, 2013, obtained and printed Feb. 18, 2016.

Foxpro Firestorm Digital Game Caller, announced Oct. 2012, [online], site visited Oct. 6, 2015. Available from Internet, <URL: http://www.chuckhawks.com>.

* cited by examiner

GAME CALL SPEAKER SYSTEM

CROSS-REFERENCE TO RELATED APPLICATIONS

The present application claims priority under 35 U.S.C. §119(e) to U.S. Provisional Application No. 61/923,568 filed on Jan. 3, 2014, which is hereby incorporated by reference in its entirety. The present application claims priority U.S. Design Application No. 29/478385 filed on Jan. 3, 2014, which is hereby incorporated by reference in its entirety.

BACKGROUND

Field

The disclosure generally relates to devices and methods for generating sounds. More specifically, the disclosure relates to such systems including rotatable game call speakers and a method of using such devices. In some embodiments, the speakers may be used for attracting animals.

Description of the Related Art

Hunters and other outdoorsmen may use sound generators including traditional game calls and electronic game calls to attract animals to a desired location. Existing game call systems are designed to produce specific sounds. Some of the sounds may emulate or mimic those made by animals. Other sounds may be different from the sounds made by animals. Existing game callers often require the user to be collocated with the game call unit during operation, such as when a user blows into a traditional game call, or when a user physically manipulates the orientation of the an electronic game call to direct sound in a particular direction.

SUMMARY

It can be desirable for hunters and other users to position themselves remote from the game call system, such as when the game call system is placed in a clearing or other desirable location for attracting game while the hunter moves to a concealed or different location. Additionally, it can be desirable to adjust the direction in which sound emanates from the speaker system. According to certain aspects, a game call speaker system is provided that for automated adjustment of the direction of sound propagation. For example, in some embodiments one or more speaker units of the game call system are rotatable to direct the sound in the preferred direction. In some embodiments, the movement (e.g., rotation) of the speaker units is controlled remotely. In some embodiments, the emission of sounds, the duration of sounds, and/or the direction of sound is controlled remotely.

The game call speaker systems described herein can be operated by the user, based on his or her current environment. For instance, the speaker units according to some embodiments can be controlled via wireless remote control to vary the pointing direction of one or more speakers. In some embodiments, one or more speakers units can be movable and/or rotatable about an axis. According to certain embodiments, the position of at least two speaker units is independently adjustable. In some embodiments, each speaker unit is controllable via independent motors. The one or more speaker units can be configured to span a relatively wide range of movement. In some embodiments, the speaker units are situated on either end of the game call unit. In some embodiments, each speaker unit pivots through a range of motion spanning at least about 180 degrees, e.g., where a sound propagation axis for each speaker unit has a range of motion spanning at least about 180 degrees. In some embodiments, the motion of two or more speaker units combine to provide up to about 360 degrees of sound direction coverage. Therefore, the user can fine tune the pointing direction of the speaker units via a remote control and from a remote location. The game call speaker system allows the user to adapt to the environment, such as to probe different areas in the theater for the presence of game or to adjust for changes in wind direction, etc.

In some embodiments, the game call speaker system can be configured to output animal sounds or sounds otherwise designed to attract wildlife to the area in which the game call speaker system is located. In certain embodiments, the game call speaker system can be controlled to emit multiple sounds. For instance, each speaker unit can include multiple speakers and different speakers can be configured to independently output different sounds, either simultaneously or in an alternating fashion. This can be particularly useful where different types of game are present in the area, or where the same type of animal is attracted to multiple sounds. A user can remotely select one type of call to output from one speaker or speaker unit, and another type of call to output from another speaker or speaker unit. The sounds can be output simultaneously or in alternation. In some embodiments multiple sounds can additionally be mixed together into a single output stream for transmission via the same speaker.

A game call speaker system can be provided. The game call speaker system can include a body portion having a bottom portion. The game call speaker system can include first and second electric motors. The game call speaker system can include a first speaker unit comprising a first speaker and coupled to the first electric motor. In some embodiments, the first speaker unit is configured to rotate relative to the body portion under control of the first motor over a range of motion spanning greater than 90 degrees about a first axis. The game call speaker system can include a second speaker unit comprising a second speaker and coupled to the second electric motor. In some embodiments, the second speaker unit is configured to rotate relative to the body portion under control of the second motor over a range of motion spanning an angle greater than 90 degrees about a second axis. In some embodiments, rotation of the first speaker unit is independent of rotation of the second speaker unit. In some embodiments, the first axis is substantially parallel to the second axis. The game call speaker system can include a memory comprising one or more stored game calls.

In some embodiments, the first speaker unit is configured to rotate relative to the body portion under control of the first motor over a range of motion spanning approximately 180 degrees about the first axis. In some embodiments, the second speaker unit is configured to rotate relative to the body portion under control of the second motor over a range of motion spanning an angle of approximately 180 degrees about the second axis. In some embodiments, the first and second speaker units can be selectively controlled to emit the stored game calls in substantially 360 degrees relative to the body portion. In some embodiments, the game call speaker system can include audio electronics configured to electrically control the first speaker unit and the second speaker unit. In some embodiments, the game call speaker system can include a control unit operably coupled to the first speaker unit and the second speaker unit. In some embodiments, the control unit is configured to respond to commands to independently rotate the first speaker unit and the second speaker unit. In some embodiments, the game call speaker system can include an interface allowing the user to enter commands for operating the game call speaker system. In some embodiments, the game call speaker system can include a remote interface configured to wirelessly receive commands from a remote control. In some embodiments, the first axis is a substantially vertical axis along the height of the game call speaker system. In some embodiments, the second axis is a substantially vertical axis along the height of the game call speaker system. In some embodiments, the first speaker unit is positioned at a first end of the body portion and the second speaker unit is position at a second end of the body portion. In some embodiments, the game call speaker system can include an audio processor in communication with the memory and responsive to commands to access a selected game call from the memory and to drive at least one speaker unit to audibly output selected game call. In some embodiments, the audio processor is configured in at least one operational mode to drive the first speaker unit to audibly output a first game call accessed from the memory and to drive the second speaker unit to audibly output a second game call accessed from the memory. In some embodiments, the audio processor is configured in the at least one operational mode to drive the first speaker unit to audibly output the first game call and to drive the second speaker unit to audibly output the second game call simultaneously.

A method of using a game call speaker system can be provided. The method can include with a first powered motor, rotating a first speaker unit of the game call speaker system about a first axis. The method can include the step of with a second powered motor, rotating a second speaker unit of the game call speaker system about a second axis, wherein rotation of the first speaker unit is independent of rotation of the second speaker unit. The method can include the step of accessing a memory comprising one or more stored game calls. The method can include the step of audibly outputting one of the stored game calls using the first speaker unit. The method can include the step of audibly outputting one of the stored game calls using the second speaker unit The method can include the step of controlling the rotation of the first speaker unit and the second speaker unit with a remote control. The method can include the step of rotating the first speaker unit while emitting sounds from the first speaker unit. The method can include the step of rotating the second speaker unit while emitting sounds from the second speaker unit. In some embodiments, rotating the first speaker unit comprises rotating the first speaker unit such that a pointing axis of the first speaker unit swings along an angle spanning at least about 90 degrees.

A game call speaker system can be provided. The game call speaker system can include a body portion. The game call speaker system can include a speaker. The game call speaker system can include a motor. The game call speaker system can include a memory comprising one or more electronically stored game calls. In some embodiments, actuation of the motor causes a change in the pointing direction of the speaker. In some embodiments, the speaker is contained within a speaker housing that is movable with respect to the body portion.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION

Figure 1:
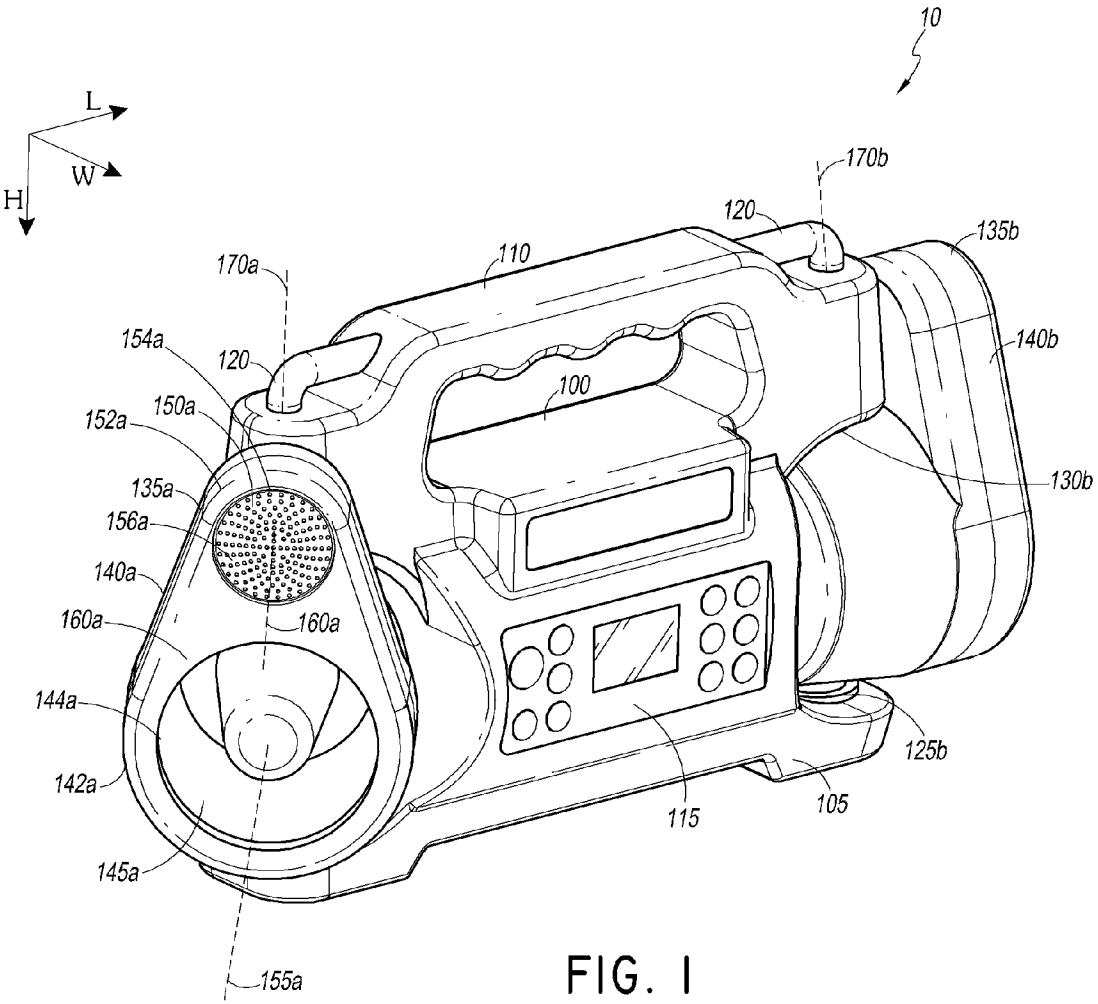
FIG. 1 illustrates a side perspective view of an embodiment of a game call speaker system.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the art and having possession of this disclosure, are to be considered within the scope of the inventions.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

FIG. 1 shows an embodiment of the game call speaker system 10. The game call speaker system 10 includes a body 100. The body 100 can be utilized as a cover to protect internal features such as motors and circuitry.

The body 100 can include a base 105. The base 105 may be generally located on the bottom of the body 100 and the body 100 may rest on the base 105. The base 105 may function to support the body 100 when the body 100 is rested upon a surface. The base 105 can include features such as feet or pads which support the body 100. The base 105 can be used to stabilize the body 100 when the game call speaker system 10 is positioned. The base 105 may be enlarged (e.g., larger footprint than the body 100) to provide greater stability to the game call speaker system 10. The base 105 may be several inches wide and several inches deep, such that when the base 105 is rested upon a surface, the body 100 may be generally stable and may resist tipping over. The speaker body 100 is relatively small in some embodiments, enhancing portability. For instance, the body 100 in some embodiments is less than about 25 inches long when the speaker units 135*a*, 135*b* are pointing straight out in opposing directions, less than about 10 inches wide, and less than about 15 inches tall. In some embodiments, the body 100 is about 13 inches long when the speaker units 135*a*, 135*b* are pointing out, about 4.25 inches deep, and about 7 inches tall.

The body 100 can include a handle 110. The handle 110 may be generally located at or near the top of the body 100. The handle 110 may be configured to be easily grabbed by a user. A user may be able to easily place his hand through the space beneath the handle 110 and grip the handle portion 110 in a manner that allows the user to support and transport the body 100. The handle 110 can include ridges or other features that facilitate gripping of the game call speaker system 10. In some embodiments, the handle 110 is integrally formed with the body 100.

The handle 110 or other appropriate portion of the body 100 may comprise one or more loops 120. Each loop 120 may be configured to accept a rope, clip, or other securing device. The securing device may attach to one or more loops 120. In some embodiments, the securing device permits the game call speaker system 10 to be mounted to a tree or other structure. The loops 120 may also be used to secure the body 100 to another object such that movement of the body 100 is restricted in one or more directions.

In some embodiments, the body 100 or the base 105 can additionally include at least one mount (not shown in FIG. 1). The mount allows the body 100 to be mounted to a tripod or other platform or structure for supporting the game call speaker system 10. For instance, utilizing the mount may permit the game call speaker system 10 to be located a distance above the ground. In some embodiments, the mount can be adjustable in height, tilt, rotation, etc. The mount allows users to achieve desired elevation and/or other desired orientation. The mount may be useful in environments such as a clearing where a tree or other existing structure is not present.

The game call speaker system 10 comprises one or more speaker units 135 (e.g., one speaker, two speakers, three speakers, four speakers, etc.). In the illustrated embodiment, the game call speaker system 10 includes a first speaker unit 135*a* and a second speaker unit 135*b*. The first speaker unit 135*a* may be identical to the second speaker unit 135*b*. The first speaker unit 135*a* may have all the same features as the second speaker unit 135*b*. In the description below, one of the speakers units (e.g., 135*a*) may be described. In some embodiments, the other speaker unit (e.g., 135*b*) has the same or similar features or configuration. In some embodiments, a speaker unit 135 may comprise one speaker, two speakers, three speakers, four speakers etc. Each speaker unit 135 may comprise the same number of speakers as another speaker unit 135 (e.g., FIG. 1, both speaker units 135*a*, 135*b* comprise two speakers). Each speaker unit 135 may comprise a different number of speakers as another speaker unit 135 (e.g., speaker unit 135*a* comprises one speaker and speaker unit 135*b* comprises two speakers).

Each speaker unit 135*a*, 135*b* may comprise a housing 140*a*, 140*b*. The housing 140*a* may provide a cover for the speaker components. Features are described with respect to the first speaker unit 135*a*. In some embodiments, the second speaker unit 135*b* has the same or similar features to the first speaker unit 135*a*.

In some embodiments, the first speaker unit 135*a* includes a first speaker 145*a* and a second speaker 150*a*. In some embodiments, the first speaker 145*a* of the first speaker unit 135*a* may be different from the second speaker 150*a* of the same speaker unit 135*a*. For instance, as a non-limiting example, the first speaker 145*a* may be configured to project sounds in a first frequency range and the second speaker 150*a* may be configured to project sounds in a second frequency range, wherein the first and second frequency ranges are not the same. In some embodiments, the first speaker 145*a* may be a woofer or subwoofer configured to project sounds that have a lower frequency than the second speaker 150*a*, which may be a tweeter, mid-range driver, or the like. It may be advantageous to have two or more speakers per speaker unit 135*a* that have different frequency ranges, in order to obtain the desired sound quality, yet still be able to project sounds over a wide frequency range. Different combinations of subwoofers, woofers, mid-ranger speakers, and tweeters are contemplated. Lengths, widths, and heights of certain movable components will now be discussed with respect to the fixed axes labeled L, W, and H on FIGS. 1 and 3B, respectively. These lengths, widths, and heights are intended to reflect the lengths, widths, and heights of the respective components when the speaker housings 140*a*, 140*b* are pointing straight out, parallel with the axis labeled L, as is shown in the configuration shown in FIG. 3B. The first speaker 145*a* may have a greater length than the second speaker 150*a*, with this axis labeled L in FIGS. 1 and 3B The first speaker 145*a* may have a greater width than the second speaker 150*a*, with this axis labeled W in FIGS. 1 and 3B. The first speaker 145*a* may have a greater height than the second speaker 150*a*, with this axis labeled H in FIGS. 1 and 3B.

The housing 140*a* may have a first portion 142*a* configured to contain the first speaker 145*a*. The housing 140*a* may have a second portion 152*a* configured to contain the second speaker 150*a*. The first portion 142*a* may have a greater length than the second portion 152*a*. The first portion 142*a* may have a greater width. In some embodiments, the housing 140*a* may be generally tear-shaped. In some embodiments, the housing 140*a* may include rounded edges.

As shown, the first portion 142*a* of the housing 140*a* can include a first opening 144*a* which permits sound emanating from the first speaker 145*a* to exit the housing 140*a*. Similarly, the second portion 152*a* can include a second opening 154*a* which permits sound emanating from the second speaker 150*a* to exit the housing. For instance, in the illustrated embodiment sound generated by the first speaker 145*a* and the second speaker 150*a* exits the housing 140*a* via exit planes defined by the first and second openings 144*a*, 154*a* respectively, where the exit planes are parallel to the front surface 162 of the housing 140*a*. As shown with respect to the second speaker 150*a*, the opening in some cases is covered by a speaker cover 156*a*, which can be made from a sound permeable material (e.g., perforated plastic, mesh fabric, etc.)

In some embodiments such as the illustrated embodiment, where the first speaker 145*a* is larger than the second speaker 150*a*, the first opening 144*a* may be larger than the second opening 154*a*. For instance, the area of the exit plane defined by the first opening 144*a* may be larger than the area of the exit plane defined by the second opening 154*a*. In the illustrated embodiment, for example, the first and second openings 144*a*, 154*a* are circular, and the diameter of the exit plane defined by the first opening 144*a* is larger than the diameter of the exit plane defined by the second opening 154*a*. In other embodiments, one or both of the openings 144*a*, 154*a* can have other shapes (e.g., ovular, elliptical, square, rectangular, etc.).

In some embodiments, the first speaker 145*a* comprises a speaker axis 155*a* or primary audio axis around which the first speaker 145*a* is configured to project sound. The front of the first speaker 145*a* may generally form a plane, and the speaker axis 155*a* may be perpendicular to this plane. The first speaker 145*a* and the second speaker 150*a* may be generally aligned along an axis, and the speaker axis 155*a* may be perpendicular to this axis. Parts of the speaker 145*a* may comprise a conical or frustoconical shape which has a center line. The centerline of the conical or frustoconical shape may be parallel or collinear to the speaker axis 155*a*. The front of the second speaker 150*a* may generally form a plane. In some embodiments the plane of the second speaker 150*a* and the plane of the first speaker 145*a* may be coplanar. In some embodiments the plane of the second speaker 150*a* and the plane of the first speaker 145*a* are not coplanar. In some embodiments the second speaker 150*a* may comprise a speaker axis 160*a* that is parallel or substantially parallel to the speaker axis 155*a* of the first speaker 145*a*.

The game call speaker system 10 can include one or more speaker unit mounts that may provide support for the speaker units 135*a*, 135*b*. In the illustrated embodiments the first speaker unit 135*a* is connected to the body 100 by two mounts (not shown in FIG. 1; shown in FIGS. 4-6) a lower speaker mount 125*a* and an upper speaker mount 125*b*. In the illustrated embodiment, the second speaker unit 135*b* is connected to the body 100 by two mounts including a lower speaker mount 125*b* and an upper speaker mount 130*b*.

Features are described with respect to the second speaker unit 135*b*. In some embodiments, the second speaker unit 135*b* has the same or similar features to the first speaker unit 135*a*. A lower speaker unit mount 125*b* may be located on the body 100 generally near the base 105. The lower speaker unit mount 125*b* may provide support for the second speaker unit 135*b*. The lower speaker unit mount 125*b* may allow rotational movement of the second speaker unit 135*b* relative to the rest of the body 100. The lower speaker unit mount 125*b* may be disposed on or near the bottom of the housing 140*b*. The lower speaker mount 125*b* may directly or indirectly connect the second speaker unit 135*b* to other parts of the body 100.

An upper speaker unit mount 130*b* may be located on the body 100 generally near the handle 110. The upper speaker unit mount 130*b* may provide support for the second speaker unit 135*b*. The upper speaker unit mount 130*b* may allow rotational movement of the second speaker unit 135*b* relative to the rest of the body 100. The upper speaker mount 130*b* may be disposed on or near the top of the housing 140*b*. The upper speaker mount 130*b* may directly or indirectly connect the second speaker unit 135*b* to other parts of the body 100.

The body 100 may comprise a lower speaker unit mount 125*a* (not shown in FIG. 1) and an upper speaker unit mount 130*a* (not shown in FIG. 1) that may be connected to the first speaker unit 135*a*, and a lower speaker unit mount 125*b* and an upper speaker unit mount 130*b* that may be connected to the second speaker unit 135*b*. In some embodiments the two lower speaker unit mounts 125*a*, 125*b* are located on opposite ends of the body 100 and the two upper speaker unit mounts 130*a*, 130*b* are also located on opposite ends of the body 100. The lower speaker unit mounts 125*a*, 125*b* and the upper speaker mounts 130*a*, 130*b* need not be located on opposite ends of the body 100.

Each speaker unit 135*a*, 135*b* is configured to rotate about an axis relative to other parts of the body 100. The speaker unit mounts 125*a*, 130*a* associated with the first speaker unit 135*a* can be aligned along the axis 170*a*. The axis 170*a* is generally along the height of the game call speaker system 10. In some embodiments, the axis 170*a* about which the first speaker unit 135*a* is configured to rotate may be vertical or substantially vertical. The first speaker unit 135*a* may be configured to rotate between 0 and 180 degrees, or more, about the respective axis 170*a*. The second speaker unit 135*b* may be configured to rotate between 0 and 180 degrees, or more, about the respective axis 170*b*.

In one configuration, the first speaker unit 135*a* may be positioned such that the face of the speaker unit 160*a* is pointed forward, and the speaker axis 155*a* of the first speaker 145*a* is pointed in a forward direction. In another configuration, the first speaker unit 135*a* may be positioned such that the face of the speaker unit 160*a* is pointed to the side. In another configuration, the first speaker unit 135*a* may be positioned such that the face of the speaker unit 160*a* is pointed backwards.

The speaker unit mounts 125*b*, 130*b* associated with the second speaker unit 135*b* can be aligned along the axis 170*b*. The axis 170*b* is generally along the height of the game call speaker system 10. In some embodiments, the axis 170*b* about which the second speaker unit 135*b* is configured to rotate may be vertical or substantially vertical. In some embodiments, the axis 170*a* may be parallel or substantially parallel to the axis 170*b*. The first speaker unit 135*a* and the second speaker unit 135*b* are configured to rotate about their respective axes 170*a*, 170*b* (described further below). The rotational movement can be continuous, or substantially continuous between one position and another position. In some embodiments, each speaker unit 135*a*, 135*b* can be selectively stopped at any position within the range of movement. Moreover, the selected audio output (described further below) can be continuously provided during the automated movement.

The axes 170*a*, 170*b* are generally vertical. The upper speaker unit mounts 130*a*, 130*b* and lower speaker unit mounts 125*a*, 125*b* may be configured such that the speaker units 135*a*, 135*b* are configured to rotate about their respective axis 170*a*, 170*b*, but substantially prevented from translating laterally or vertically. In some embodiments, the upper speaker unit mounts 130*a*, 130*b* and lower speaker unit mounts 125*a*, 125*b* constrain the speaker units 135*a*, 135 to rotate about the axes 170*a*, 170*b*. In some embodiments, the upper speaker unit mounts 130*a*, 130*b* and lower speaker unit mounts 125*a*, 125*b* may also be configured to substantially prevent the speaker units 135*a*, 135*b* from rotating about a horizontal axis (e.g., an axis perpendicular to the axes 170*a*, 170*b*). In some embodiments, the axes 170*a*, 170*b* about which the speaker units 135*a*, 135*b* are configured to rotate may at some angle between vertical and horizontal.

The number and locations of the speaker unit mounts 125*a*, 125*b*, 130*a*, and 130*b* may vary from the depicted embodiment. In some embodiments, the game call speaker system 10 comprises three speaker units. The body 100 comprises three lower speaker mounts and three upper speaker mounts. In some embodiments, the game call speaker system 10 comprises four speaker units. In such cases, the body 100 can comprise four lower speaker mounts and four upper speaker mounts.

The game call speaker system 10 can include a user interface 115. The user interface 115 may allow the user to modify some or all of the parameters of the game call speaker system 10 (e.g., the game call being emitted, the direction of the speaker units 135*a*, 135*b*, the volume of the sound, whether the game call speaker system 10 is on). The user interface 115 may comprise a display. The display may be used to visually communicate information from the game call speaker system 10 to the user. The user interface 115 may comprise one or more buttons. The buttons may be used to allow the user to manually change a parameter or input a condition (e.g., such as turning on the game call speaker system 10).

In some embodiments, the user interface 115 can be integrally formed with the body 100. As a point of reference, the user interface 115 is shown on the front of the game call speaker system 10. The user interface 115 can be located on or near the back, top or side of the game call speaker system 10. The user interface allows a user to change a parameter of the game call speaker system 10 (as described in greater detail below). In some embodiments, the game call speaker system 10 comprises more than one user interface 115 (e.g., two, user interfaces three user interfaces, four user interfaces, etc.). The multiple user interfaces 115 may allow the user to move relative to the game call speaker system 10 without repositioning the game call speaker system 10.

Figure 2:
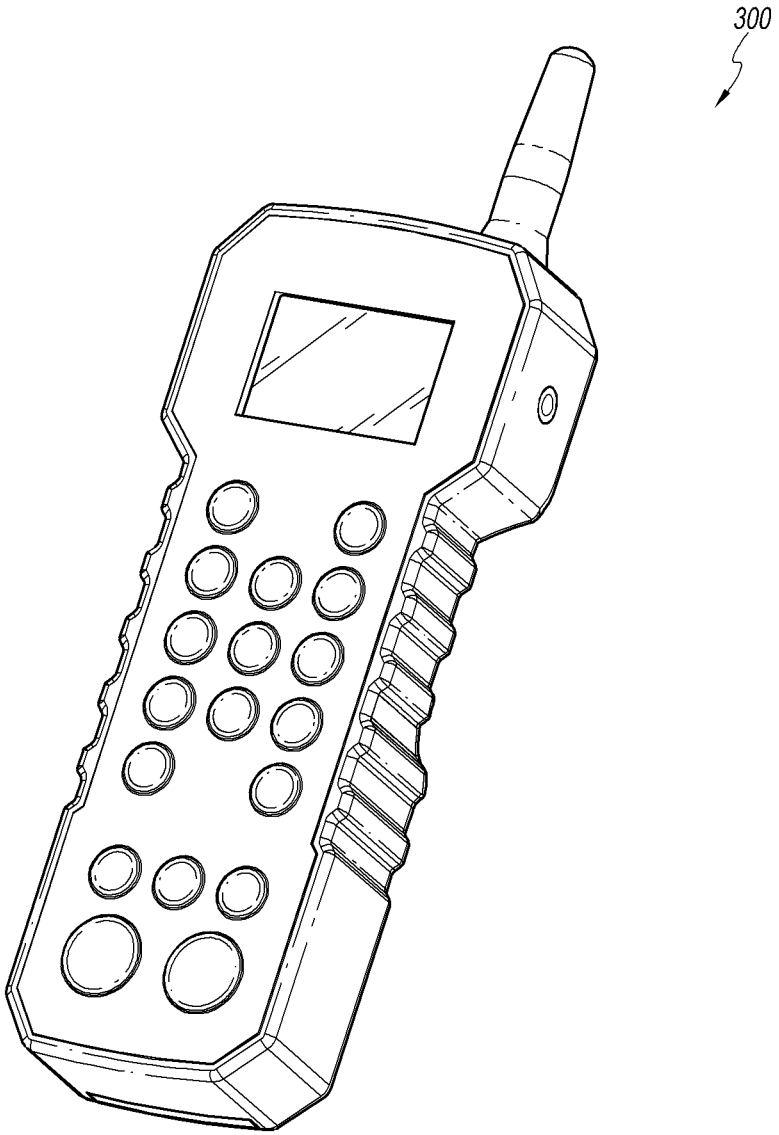
FIG. 2 illustrates a top perspective view of an embodiment of a remote control.

The user interface 115 can be configured to receive signals by a remote control 300 as shown in FIG. 2 to control some or all of the parameters of the game call speaker system 10. The parameters that may be modified via the user interface 115 need not be the same as those that may be modified via the remote control 300. The scope of the inventions are not limited by the method of inputting information into the game call speaker system 10.

The remote control 300 may allow the user to communicate information and send a signal to the game call speaker system 10 from a remote location. As such, it may be unnecessary for the user to be at the same physical location as the game call speaker system 10. It may be advantageous for the user to not have to be at the same physical location as the game call speaker system 10. For instance, the game call speaker system 10 may project sounds that attract certain animals towards the game call speaker system 10. It may be beneficial for the user to be in a position away from the game call speaker system 10 (e.g., to avoid the human scent near the game call speaker system 10, to reduce noise near the game call speaker system 10). For instance, the game call speaker system 10 may be located in an open area and the user may be in a tree stand or otherwise concealed.

The remote control 300 may comprise a display and/or one or more buttons. The remote control 300 may comprise a power supply. The power supply may comprise a battery or other source of electrical power. The remote control 300 can be configured to send and/or information to the user interface 115 of the game call speaker system 10. In some embodiments, the remote control 300 communicates by sending and receiving information to a remote interface (not shown) which may or may not be separate from the user interface 115. As described herein, the remote control 300 may be configured to send radiofrequency (RF) signals). The remote control 300 may interact with a remote interface (not shown) configured to receive RF signals, which substantially similar to remote interfaces described herein.

Figure 3A:
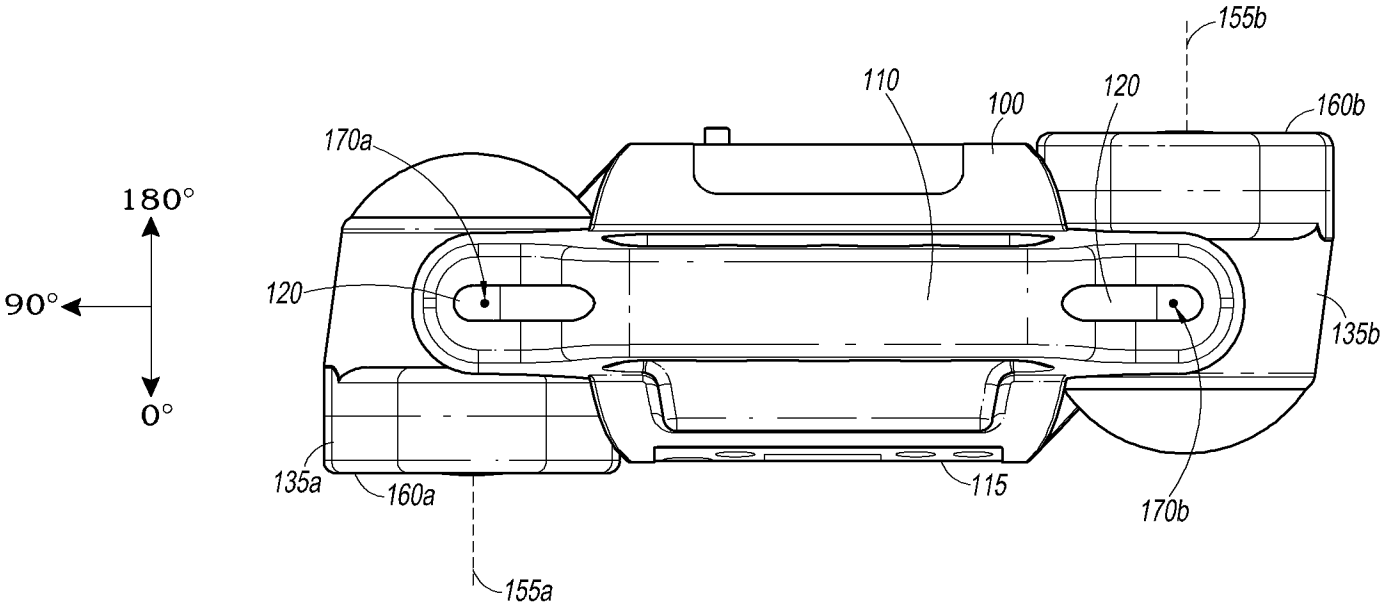
FIG. 3A illustrates a top perspective view of an embodiment of a game call speaker system with the speakers in a first position.
Figure 3B:
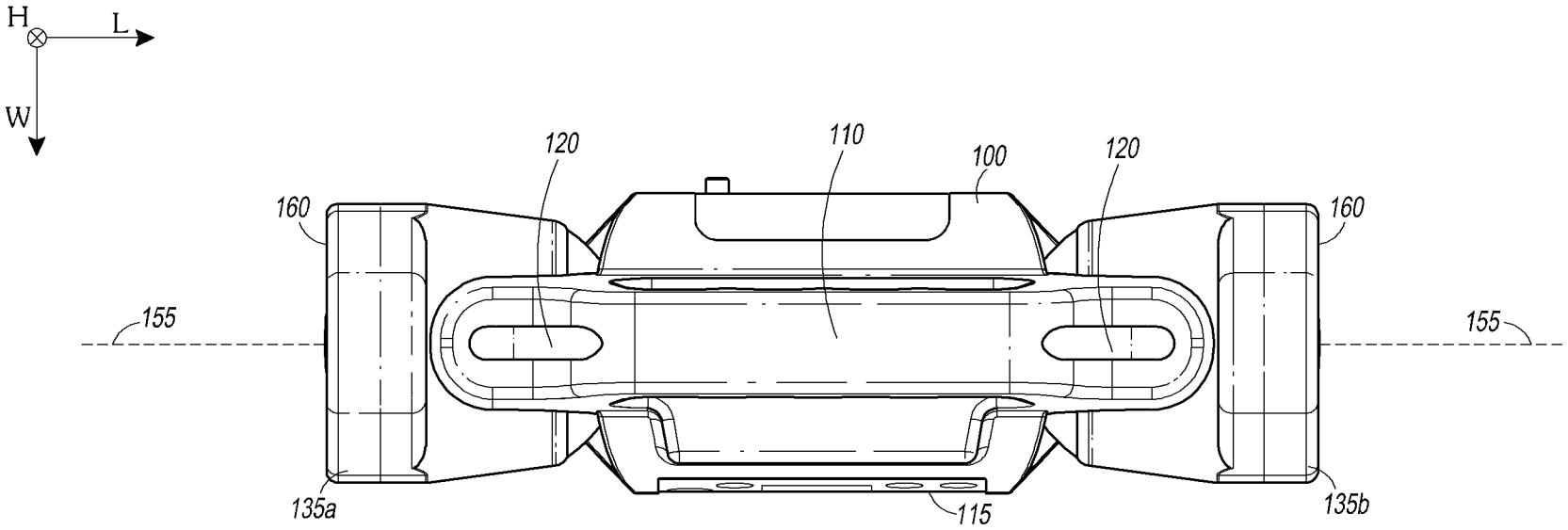
FIG. 3B illustrates a top perspective view of an embodiment of a game call speaker system with the speakers in a second position.
Figure 3C:
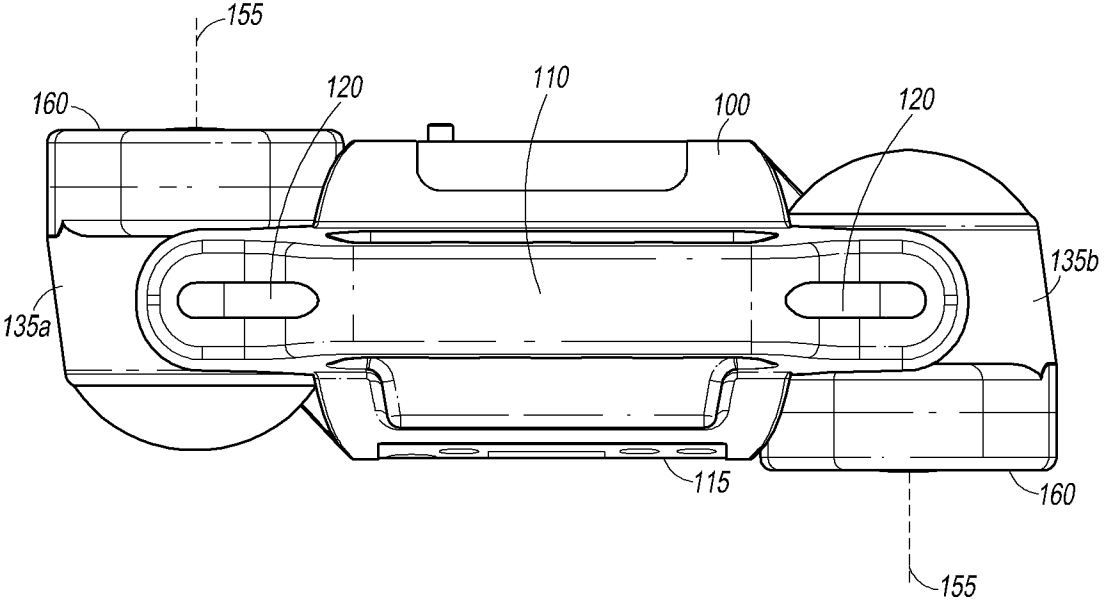
FIG. 3C illustrates a top perspective view of an embodiment of a game call speaker system with the speakers in a third position.

The direction of the speaker units 135*a*, 135*b* is one parameter of the game call speaker system 10 that can be controlled. FIGS. 3A-3C show three of the many positions that the first speaker unit 135*a* and the second speaker unit 135*b* can assume. The first speaker unit 135*a* rotates about the axis 170*a*. The second speaker unit 135*b* rotates about the axis 170*b*. As illustrated in FIG. 3A, the first speaker unit 135*a* is shown facing forward, such that the first speaker 145*a* facing toward the front of the game call speaker system 10. In other words, the speaker axis 155*a* of the first speaker unit 135*a* is pointing forward. The second speaker unit 135*b* is shown facing backwards, such that the first speaker 145*b* is facing toward the back of the game call speaker system 10. In other words, the speaker axis 155*b* of the second speaker unit 135*b* is pointing backwards. The first speaker unit 135*a* can be considered to be rotated 0 degrees with respect to the game call speaker system 10. The second speaker unit 135*b* can be considered to be rotated 180 degrees with respect to the game call speaker system 10. The second speaker unit 135*b* can be considered to be rotated 180 degrees with respect to the first speaker unit 135*a*.

As illustrated in FIG. 3B, the first speaker unit 135*a* is shown facing to the side of the game call speaker system 10. The speaker axis 155*a* of the first speaker unit 135*a* is pointing laterally to the side of the game call speaker system 10. The second speaker unit 135*b* is shown facing to the side of the game call speaker system 10. The speaker axis 155*b* of the second speaker unit 135*b* is pointing laterally to the side. In some embodiments, when the first speaker unit 135*a* is pointed laterally to one side and the second speaker unit 135*b* is pointed laterally to the opposite side, the speaker axes 155*a* of the first speaker unit 135*a* may be collinear or substantially collinear with the speaker axis 155*b* of the second speaker unit 135*b*. In some embodiments, when the first speaker unit 135*a* is pointed laterally to one side and the second speaker unit 135*b* is pointed laterally to the opposite side, the speaker axes 155*a* of the first speaker unit 135*a* may be coplanar with the speaker axis 155*b* of the second speaker unit 135*b*. The first speaker unit 135*b* can be considered to be rotated 90 degrees with respect to the game call speaker system 10. The second speaker unit 135*b* can be considered to be rotated 90 degrees with respect to the game call speaker system 10. The second speaker unit 135*b* can be considered to be rotated 180 degrees with respect to the first speaker unit 135*a*.

As illustrated in FIG. 3C, the first speaker unit 135*a* is shown facing backwards, such that the speaker axis 155*a* of the first speaker unit 135*a* is pointing backwards. In other words, first speaker 145*a* is facing toward the back of the game call speaker system 10. The second speaker unit 135*b* is shown facing forwards, such that the speaker axis 155*b* of the second speaker unit 135*b* is pointing forwards. In other words, first speaker 145*b* is facing toward the front of the game call speaker system 10. The first speaker unit 135*a* can be considered to be rotated 180 degrees with respect to the game call speaker system 10. The second speaker unit 135*b* can be considered to be rotated 0 degrees with respect to the game call speaker system 10. The first speaker unit 135*a* can be considered to be rotated 180 degrees with respect to the second speaker unit 135*b*.

The first speaker unit 135*a* can assume any position between 0 degrees with respect to the game call speaker system 10 (as shown in FIG. 3A) to 180 degrees with respect to the game call speaker system 10 (as shown in FIG. 3C), including 90 degrees with respect to the game call speaker system 10 (as shown in FIG. 3B). The second speaker unit 135*b* can assume any position between 0 degrees with respect to the game call speaker system 10 (as shown in FIG. 3C) to 180 degrees with respect to the game call speaker system 10 (as shown in FIG. 3A), including 90 degrees with respect to the game call speaker system 10 (as shown in FIG. 3B).

The first and second speaker units 135*a*, 135*b*, may be rotated independently of each other. In other words, the rotation of the first speaker unit 135*a* does not necessarily dictate or influence the rotation of the second speaker unit 135*b*. In some positions, the first and second speaker units 135*a*, 135*b*, may both point forward (e.g., both rotated 0 degrees with respect to the game call speaker system 10). In some positions, the first and second speaker units 135*a*, 135*b*, may both point backward (e.g., both rotated 180 degrees with respect to the game call speaker system 10). In some positions, the first speaker unit 135*a* and/or second speaker unit 135*b* may be positioned at an orientation other than those illustrated in FIGS. 3A-3C (e.g., both rotated 45 degrees with respect to the game call speaker system 10; one speaker unit rotated 45 degrees, other speaker unit rotated 180 degrees; one speaker unit rotated 45 degrees, other speaker unit rotated 180 degrees, etc.).

The figures illustrate speaker units 135*a*, 135*b* each adjustable within a 180 degree range, in some embodiments, the speaker units 135*a*, 135*b* may rotate more or less than 180 degrees. In some embodiments, the speaker units are each adjustable within a range of at least 180 degrees, or at least approximately 180 degrees. In various embodiments, each speaker unit 135*a*, 135*b* can be rotated in a range spanning at least about 90, 110, 130, 150, 160, 165, 170, 175, 180, 190, 210, 230, 250, or 270 degrees, or in a range spanning some value between any of the foregoing values. Depending on the embodiment, each speaker unit 135*a*, 135*b* can be configured for rotation in ranges spanning lesser angles, e.g., in a range spanning at least 30, 45, 60, 70, or 80 degrees, or in a range spanning some value between any of the foregoing values. Where the speaker units 135*a*, 135*b* can rotate within a range spanning about 180 degrees as in the illustrated embodiment, the combined coverage of the speaker unit 135*a*, 135*b* is about 360 degrees. The axes 155*a* and 155*b* can be pointed radially in substantially every direction (e.g., North, South, East, West and directions there between). In other words, the speaker units 135*a*, 135*b* can project sound in every direction (e.g., about 360 degrees with respect to the game call speaker system 10). In various implementations, the combined speaker coverage spans a range of at least about 180, 210, 240, 270, 300, 330, 340, 350, 355, or 360 degrees, or spans a range of some value between any of the foregoing values. The illustrated embodiment shows a speaker system 10 including speaker units 135*a*, 135*b* capable of rotation about the vertical axes 170*a*, 170*b*, thereby permitting adjustment of the pointing direction of the speaker units 135*a*, 135*b* within a horizontal plane. In some other embodiments, the pointing position of speaker units 135*a*, 135*b* can be adjusted in other dimensions. For instance, in one embodiment the speakers units 135*a*, 135*b* can additionally be adjusted within a vertical plane to point above and/or below the horizontal (e.g., upwards towards the sky and/or downwards towards the ground, where the base 105 of the speaker system 10 is resting on the ground). For instance, the speaker may be rotatable about the vertical axes 170*a*, 170*b* and are additionally rotatable about respective horizontal axes. For instance, referring to the speaker unit 135*a*, the speaker unit 135*a* may be rotatable about both the vertical axes 170*a* and a horizontal axis that is perpendicular to the speaker axes 155*a*.

Figure 4:
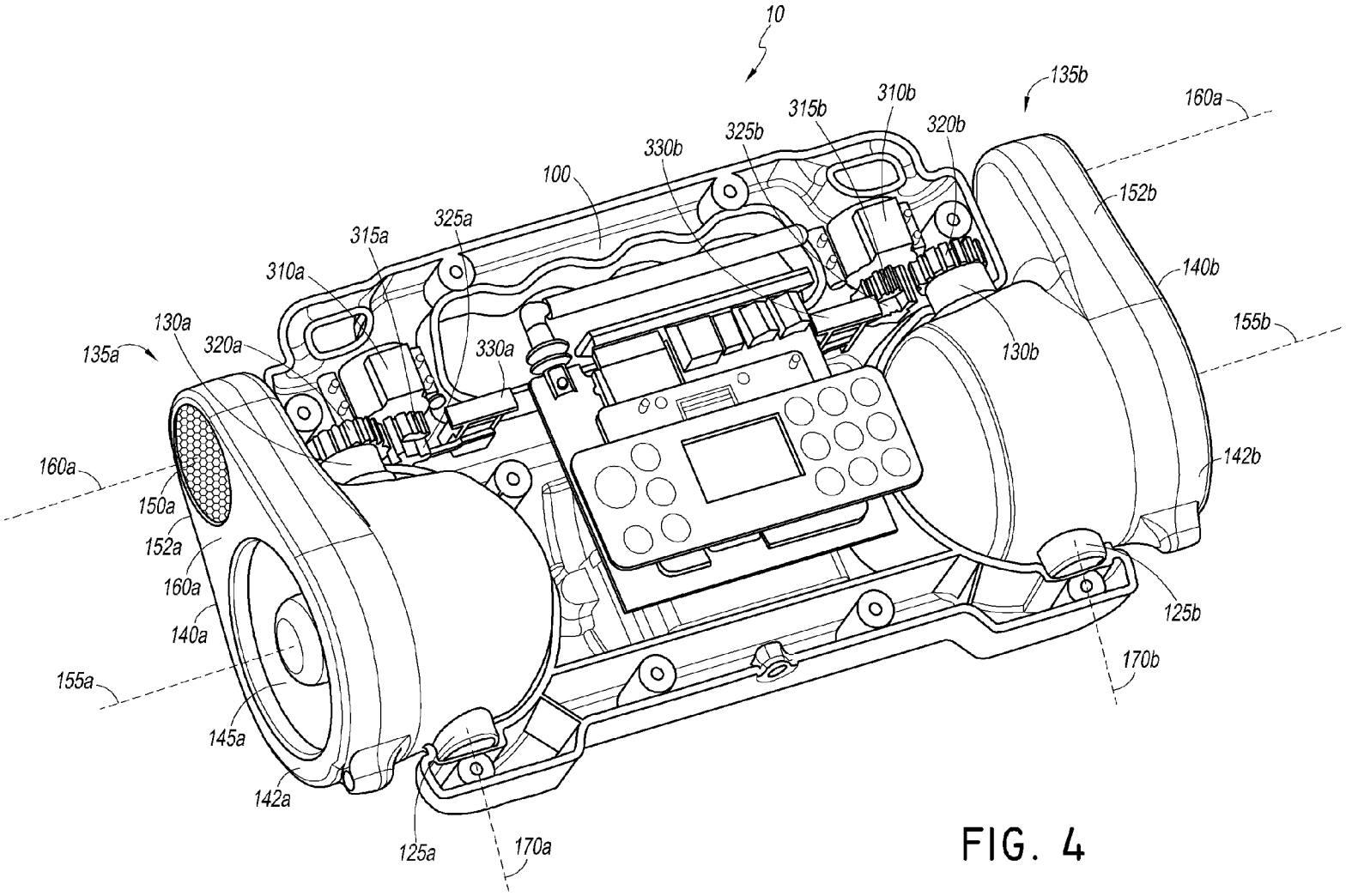
FIG. 4 illustrates a side perspective view of an embodiment of a game call speaker system with a cover removed.
Figure 5:
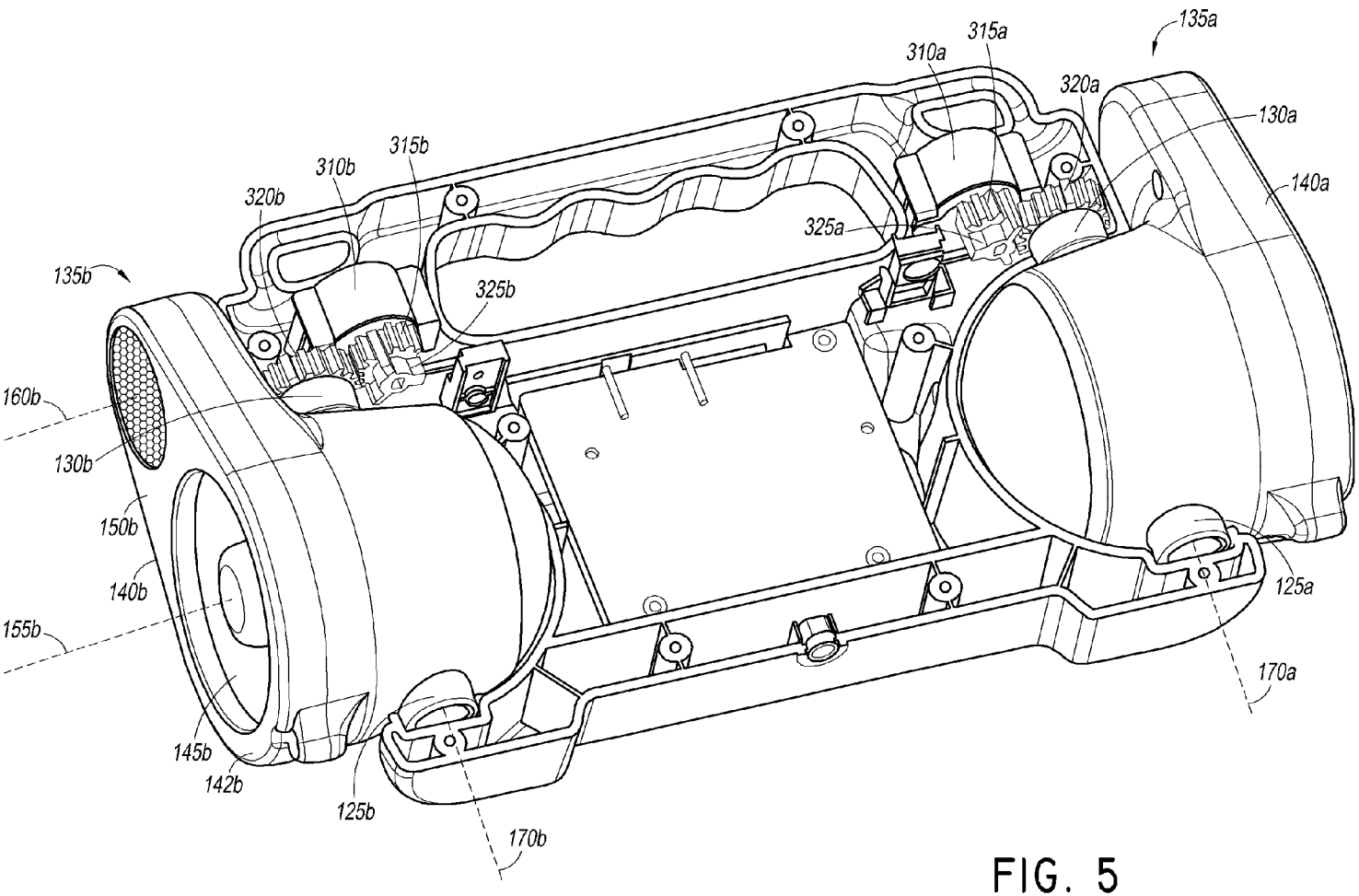
FIG. 5 illustrates another perspective view of the embodiment of a game call speaker system of FIG. 4.
Figure 6:
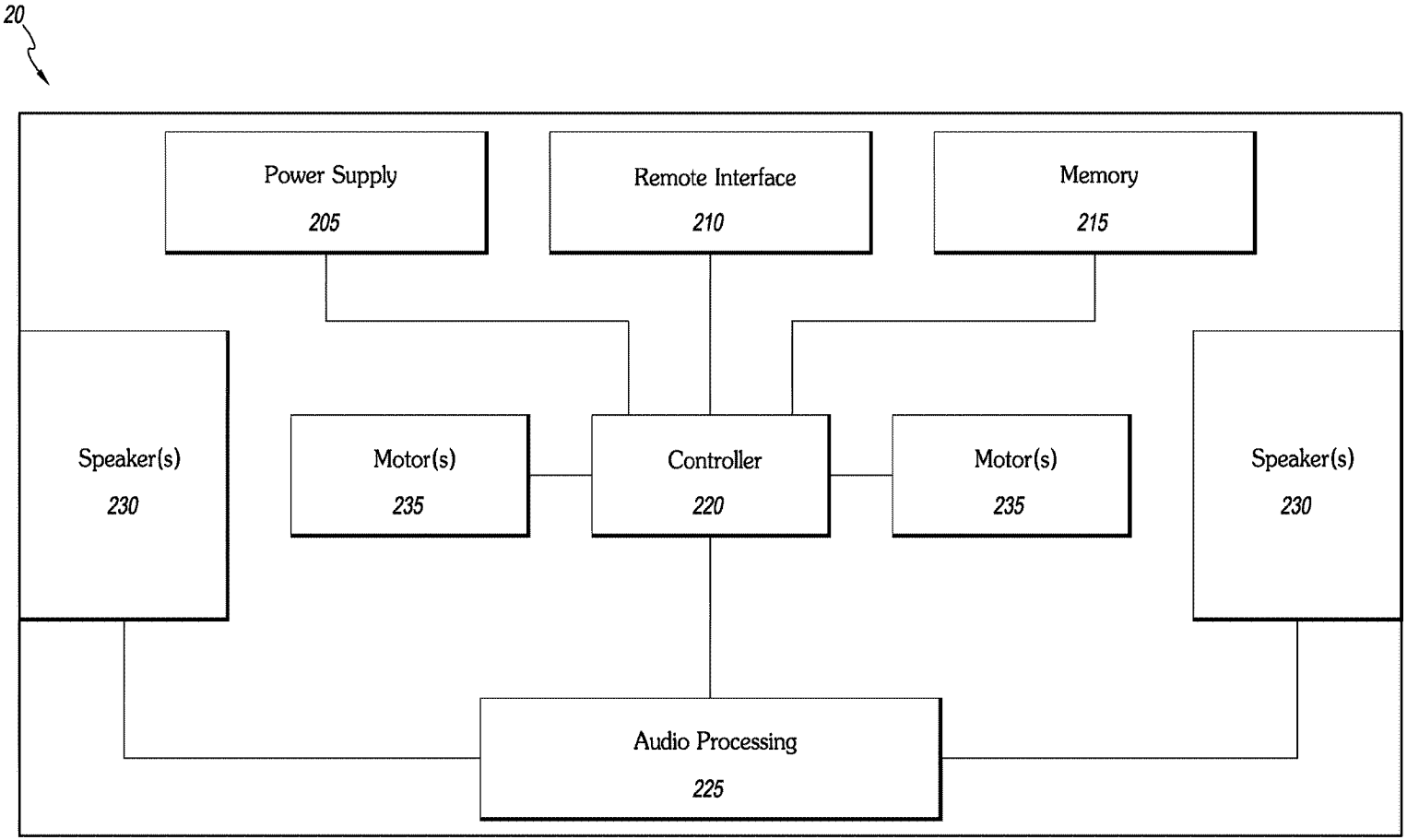
FIG. 6 illustrates a block diagram of components of an embodiment of a game call speaker system.

FIGS. 4-6 show the internal components of the game call speaker system 10. FIG. 4 shows the front side of the game call speaker system 10 and FIGS. 5-6 show the back side of the game call speaker system 10. In some embodiments the body 100 may comprise at least one motor 310*a*, 310*b* that is configured to rotate at least one speaker unit 135*a*, 135*b* independently of the body 100. The motors 310*a*, 310*b* may be located in the body 100. The motors 310*a*, 310*b* may respond to signals from a controller or other electronics also located in the body 100. In the illustrated embodiment, each of the speaker units 135*a*, 135*b* is associated with a motor 310*a*, 310*b*. Each motor 310*a*, 310*b* is connected to circuitry that connects the motors 310*a*, 310*b* to a power supply (not shown). In some embodiments, the power supply may comprise one or more batteries or battery units, which may be rechargeable. The power supply may be housed within body 100 (e.g., the open space between the speaker units 135*a*, 135*b*).

The motor 310*a* includes a shaft (not shown) extending therefrom. The first gear 315*a* is coupled to the shaft of the motor 310*a*. As the motor 310*a* rotates, the first gear 315*a* will rotate. The gear 315*a* engages a second gear 320*a*. The second gear 320*a* can be size relative to the first gear 315*a* such that two revolutions of the second gear 320*a* will cause one revolution of the second gear 320*a*, for instance if the gear ratio is 2:1. Other gear ratios are contemplated. Rotation of the first gear 315*a* will cause rotation of the second gear 320*a* in an opposite direction. In other words, rotation of the first gear 315*a* in the clockwise direction causes rotation of the second gear 320*a* in the counterclockwise direction. In the illustrated embodiment, the second gear 320*a* is rigidly coupled to the upper speaker unit mount 130*a*. Rotation of the motor 310*a* causes rotation of the first gear 315*a*, rotation of the second gear 320*a*, and rotation of the first speaker unit 135*a*.

As previously described, the speaker unit mounts 125*a*, 130*a* associated with the first speaker unit 135*a* can be aligned along the axis 170*a*. The axis 170*a* is generally along the height of the game call speaker system 10. In some embodiments, the upper speaker unit mount 130*a* is retained but rotatable within the body 100. For instance, the upper speaker unit mount 130*a* may comprise a cylindrical member that is freely rotatable within a circular indent in the body 100. In some embodiments, the lower speaker unit mount 125*a* is retained but rotatable within the body 100. For instance, the lower speaker unit mount 125*a* may comprise a cylindrical member that is freely rotatable within a circular indent in the body 100.

In some embodiments, the shaft of the motor 310*a* is coupled to a third gear 325*a*. Rotation of the motor 310*a* causes rotation of the first gear 315*a*, and rotation of the third gear 325*a*. In some embodiments, the third gear 325*a* is coupled to a counter 330*a* that measures the number of rotation of the motor 310*a*. In some embodiments, the third gear 325*a* is coupled to a stop that prevents further rotations of the motor 310*a*. The motor 310*b* associated with the second speaker unit 135*b* includes the same features, including the first gear 315*b*, the second gear 320*b* and the third gear 325*b*.

The motors 310*a*, 310*b* and corresponding gears 315*a*, 320*a*, 315*b*, 320*b* can be located near the upper speaker mounts 130*a*, 130*b* and near the handle 110. This configuration allows the relatively large and heavy speaker units 135*a* to be positioned lower relative to housing 100, and may therefore allow for a lower center of gravity for the game call speaker system 10, thereby increasing the stability of the device.

Generally, locating the motors 310*a*, 310*b* and corresponding gears 315*a*, 320*a*, 315*b*, 320*b* relatively higher in the body 100 such as in the illustrated embodiment serves to keep components that are relatively sensitive to moisture or other external contaminants further from the ground, reducing risk of damage to those components. For instance, this configuration may shield the motors 310*a*, 310*b* from ground moisture, such as snow or rain because the motors 310*a*, 310*b* and corresponding gears 315*a*, 320*a*, 315*b*, 320*b* are physically spaced from the ground. Moreover, including the motors 310*a*, 310*b* and corresponding gears 315, 320*a*, 315*b*, 320*b* in the upper portion of the body 100 as shown can allow the portion of the body 100 that interfaces with the lower speaker mounts 125*a*, 125*b* to be sealed because the lower speaker mounts 125*a*, 125*b* do not need to interact with any components internal to the body 100, such as the second gears 320*a*, 320*b*. More specifically, the cut-outs on either side of the body 100 that are shaped to receive the lower speaker mounts 125*a*, 125*b* can be sealed, without any holes, gaps or other openings, thereby preventing contaminants from entering the body 100.

In other embodiments, the motors 310*a*, 310*b* can be located near the lower speaker mounts 125*a*, 125*b* and near the base 105. This configuration may reduce the overall height of the game call speaker system 10. In some embodiments, the longitudinal axis of the motor 310*a* is generally parallel to the axis 170*a* and the longitudinal axis of the motor 310*b* is generally parallel to the axis 170*b*. In other embodiments, the longitudinal axis of the motor 310*a* is generally perpendicular to the axis 170*a* and the longitudinal axis of the motor 310*b* is generally perpendicular to the axis 170*b*. The first gears 315*a*, 315*b* can be worm gears. This configuration may reduce the overall height of the game call speaker system 10.

A variety of additional implementations are possible for effecting powered movement of the speakers. For instance, in some embodiments, the motors 310*a*, 310*b* control a belt coupled to the speaker unit mounts 125*a*, 125*b*, 130*a*, 130*b*. The motor 310*a* can be coupled to a first pulley (not shown). The upper speaker unit mount 130*a* can be coupled to a second pulley (not shown). In some embodiments, the upper speaker unit mount 130*a* itself acts as the second pulley without additional hardware. A belt is coupled to the first pulley and the second pulley. Rotation of the motor 310*a* causes rotation of the upper speaker mount 130*a* and rotation of the first speaker unit 135*a*. In some embodiments, the belt is coupled to the lower speaker mount 125*a*. In some embodiments, the belt is a bead belt. The motor 310*b* can be coupled to a third pulley (not shown). The upper speaker unit mount 130*b* can be coupled to a fourth pulley (not shown). In some embodiments, the upper speaker unit mount 130*b* itself acts as the fourth pulley. A second belt is coupled to the third pulley and the fourth pulley. Rotation of the motor 310*b* causes rotation of the upper speaker mount 130*b* and rotation of the second speaker unit 135*b*. In some embodiments, the second belt is coupled to the lower speaker mount 125*b*. In some embodiments, the second belt is a bead belt.

In some embodiments, the motors 310*a*, 310*b* control a cable coupled to the speaker unit mounts 125*a*, 125*b*, 130*a*, 130*b* instead of a belt. For instance, motor 310*a* can control a first pulley (not shown) which is coupled to the cable. The cable can be coupled to the upper speaker unit mount 130*a* or the lower speaker unit mount 125*a*. Rotation of the motor causes rotation of the first speaker unit 135*a*. The motor 310*b* can be coupled to a second cable in a similar manner.

In some embodiments, the belt and/or the second belt is a crawler track. The crawler track can include ridges and/or depressions that increase the traction or frictional contact between the track and the pulleys. The crawler track and one or more pulleys can have an interlocking configuration (e.g., ridges and depressions, ramped surfaces, wedges, detents etc.). In some embodiments, the belt includes a V-shaped wedge, and the pulleys can include a groove to transmit more torque. In some embodiments, a chain is used between the pulleys. The chain can be more robust than the belt described herein.

In some embodiments, the shaft of the motor 310*a* is connected to a barrel cam (not shown). A cam follower (not shown) is coupled to the barrel cam. In some embodiments, the cam follower is oriented parallel barrel cam. As the barrel cam is rotated by the motor, the cam follower translates. The cam follower can be connected to the upper speaker unit mount 130*a* and/or the lower speaker unit mount 125*a*. As the cam follower is translated, the upper speaker unit mount 130*a* and/or the lower speaker unit mount 125*a* can rotate along the axis 170*a*. The motor 310*b* can be coupled to a second barrel cam in a similar manner.

In some embodiments, the motor 310*a* is connected to a coupling and the coupling is directly coupled to the upper speaker unit mount 130*a* or the lower speaker unit mount 125*a*. The longitudinal axis of the motor 310*a* can align with the axis 170*a*. The coupling can account for linearly misalignment between the motor 310*a* and the first speaker unit 135*a*. For instance, the coupling can be a simple tube having a pair of slots or grooves on each end. The shaft of the motor 310*a* can include a first pin (not shown) extending perpendicular from the shaft of the motor 310*a*. The upper speaker unit mount 130*a* or the lower speaker unit mount 125*a* can include a second pin extending perpendicularly from the axis 170*a*. In some embodiments, the first and second pins are perpendicular to each other. The rotation of the motor 310*a* causes direct rotation of the first speaker unit 135*a*. This configuration may increase the height of the game call speaker system 10. The motor 310*b* can be coupled a second coupling in a similar manner. Other devices configured to rotate the speaker units 135*a*, 135*b* are contemplated. In some embodiments the speaker system 10 can include more than two motors and corresponding gears, belts, or other coupling mechanisms for translating powered movement of the motors to move the speaker units 135*a*, 135*b*. For instance, where the speakers units 135*a*, 135*b* are rotatable within both horizontal and vertical planes, the speaker system 10 may have four total motors. In such a case, first and second motors associated with the first speaker unit 135*a* effect powered movement of the first speaker unit 135*a* within the horizontal and vertical planes, respectively, and third and fourth motors associated with the second speaker unit 135*b* can effect powered movement of the second speaker unit 135*b* within the horizontal and vertical planes, respectively.

One or more parts of the body 100, the speaker units 135*a*, 135*b* and/or the remote control 300 of the game call speaker system 10 may comprise plastic, metal, rubber, or other suitable materials. The body 100 may comprise a cover or shell that may be made from more than one section. Each section may be manufactured using various manufacturing techniques. In some embodiments, the shell comprises two or more sections, with each section being independently cast. The sections may then be attached at a later point in the manufacturing process. The shell may be manufactured by casting one or more plastic portions and then attaching the portions during production. In some embodiments, one or more parts of the body 100 and/or the remote control 300 may be partially or substantially water-proof, such that the remote control 300 may be resistant to water and other weather that may be present while in the wilderness.

The housing 140*a*, 140*b* may be made from the same or similar materials as those that comprise the body 100. In some embodiments the housing 140*a*, 140*b* may comprise two or more cast sections that may be attached. In some embodiments, the first speaker 145*a*, 145*b* and second speakers 150*a*, 150*b* may be disposed in the speaker units 135*a* 135*b* and/or the housing 140*a*, 140*b* before the game call speaker system 10 is assembled. The first speakers 145*a*, 145*b* and the second speakers 150*a*, 150*b* can be commercially available subcomponents (e.g., woofer, tweeter).

FIG. 6 shows a block diagram of a game call speaker system 20 according to some embodiments. The game call speaker system 20 may comprise electronic and/or mechanical components designed to produce and/or amplify sounds. The game call speaker system 10 of FIGS. 1-5 may include the same or similar components.

The game call speaker system 20 may include one or more speakers 230. Speakers 230 can be the same or substantially similar to speaker units 135*a*, 135*b* described herein. As one example, each speaker 230 can be configured to rotate about an axis. Each speaker can be configured to emit a sound and the coverage can be 360 degrees relative to the game call speaker system 20.

The game call speaker system 20 may comprise a power supply 205 which supplies power to the internal electronic and/or mechanical components. The power supply 205 may receive energy from various types of energy sources. Examples include electrical inputs such as AC and DC power supplies, storage devices such as a batteries and fuel cells, electromechanical inputs such as generators and alternators, solar power converters, or other such sources. In some embodiments, the power supply 205 may comprise one or more batteries or battery units, which may be rechargeable. The power supply 205 may be designed to supply power while the game call speaker system 20 is used in remote locations. The power supply 205 may be releasably secured in a compartment of the body (not shown). In some embodiments, the power supply 205 may be mounted external to the body and power may be supplied from outside of the body. In some embodiments, the game call speaker system 20 may be configured to accept 110V AC power from an external source. In some embodiments, the game call speaker system 20 may be configured to accept other types of power supplies, and the scope of the invention is not limited by the type or style of power supply used in the system.

The game call speaker system 20 may comprise a remote interface 210. In some embodiments, the remote interface is configured to receive RF signals. The remote interface 210 may be used to receive signals from a remote control 300 (not shown) operated by the user. The RF signals may be able to transmit a longer distance than other signals. The RF signals may be transmittal with less interference than other signals. The RF signals allows the user to transmit commands through walls, trees, or other obstructions. In some embodiments, the remote interface 210 authenticates the remote control 300. For instance, this prevents another user from interfering or controlling the game call speaker system 20. In some embodiments, only one remote control 300 correlates with the remote interface 210 of the game call speaker system. For instance, this allows two different game call speaker system 20 to be used in close proximity. The game call speaker system 20 operate on several frequencies. For instance, this allows two different game call speaker system 20 to be used in close proximity.

The signals received from the remote control 300 may change different parameters associated with the game call speaker system 20. For instance, as a non-limiting example, the remote interface 210 may be configured to receive signals from a remote control 300 operated by a user that increases the volume of the sounds being projected. Or, the signals may change the sounds emitted from a first animal to a second animal. Or, the signals may change the orientation and/or positioning of one or more speaker units 230. The signals may change other parameters of the game call speaker system 20, and the scope of the invention is not limited by which parameters can be remotely modified. The signals may be wireless such that the user can be located remotely from the game call speaker system 20.

In some embodiments, the remote interface 210 may be configured to send one or more signals from the game call speaker system 20 to the remote control 300. As a non-limiting example, a signal may be sent from the remote interface 210 of the game call speaker system 20 to the remote control 300 that indicates that the direction that each of the one or more speaker units 230 is facing. A signal may be sent from the remote interface 210 of the game call speaker system 20 to the remote control 300 that indicates that the game call speaker system 20 is on and/or emitting sounds. A signal may be sent from the remote interface 210 of the game call speaker system 20 to the remote control 300 that indicates which sounds are being emitted. It may be advantageous for the user to receive different signals from the remote interface 210 since in some situations, the user may not be able to determine the status of those parameters without such a signal.

In some embodiments, the game call speaker system 20 may comprise a memory 215. In some embodiments, the memory is a non-volatile memory such as a secure digital (SD) card or similar device configured to store files. The memory 215 may be used to store various sounds that may be emitted from the speakers 230. For instance, the memory can include a plurality (e.g., tens, hundreds, thousands) of game calls. In some embodiments, the game calls can be pre-loaded on the memory 215. In some embodiments, the game calls are transmitted to the game call speaker system 20 as described herein. The game calls can correspond to commonly hunted animals including duck, geese, grouse, pheasant, quail, crows, starlings, sparrows, doves, deer, elk, moose, turkey, bear, coyote, bobcats, etc. The game calls can correspond to mating calls, distress call or types of communication that may attract or have a certain effect on animals. In some embodiments, the memory 215 may be configured to store sounds that emulate or mimic certain animals. By projecting sounds that emulate animals, the animals may be drawn towards the game call speaker system 20 and within range of the user. This is particularly advantageous when the user is a hunter and the game call lures the target animal. However, the game call speaker system 20 can be utilized by non-hunters, such as birdwatchers or conservationists.

In some embodiments, the memory 215 may be internal to the game call speaker system 20 (e.g., located within the body). The memory 215 can be placed within the body 100 or within the housings 140*a*, 140*b*. In some embodiments, the memory 215 may be integral with the game call speaker system 20 (e.g., not removable). In other embodiments, the memory 215 may comprise a removable portion that can be loaded by a user. The memory can store the calls of regional animals. The user may be able to swap the memory 215 for another memory 215 if the user is traveling to a different region. The memory can store the calls of animals based on the season. The user may be able to swap the memory 215 for another memory 215 based on the type of animal the user is interested in luring and the season. In some embodiments, the user may be able store animal sounds on a reusable memory device (not shown) and then load this memory device into the game call speaker system 20. Such a configuration may allow a user to customize the sounds that may be projected by the game call speaker system 20.

In some embodiments, the memory 215 is stored on a non-volatile computer storage medium. For instance, the memory can be stored a USB flash drive which uses flash memory. Examples of non-volatile memory include read-only memory, flash memory, types of RAM, hard disks, floppy disks, magnetic tape, and optical discs. In other embodiments, the memory 215 is stored on a volatile computer storage medium. A volatile memory requires power to maintain the stored information, which may not be practical in all applications of the game call speaker system 20.

In some embodiments, game calls are stored external to the game call system 20 instead of or in addition to being stored in the on-board memory 215. For example, in some embodiments, game calls are stored on or otherwise accessible from a user's mobile phone or other mobile device (e.g., tablet, computer, etc.). The mobile device can include a user interface which allows the user to access and select the desired game call. Depending on the embodiment, the mobile device accesses the stored game calls from a cloud location or other storage location remote from the mobile device, or from a memory internal to the mobile device, and streams the selected game call to the game call speaker system 20 over a wireless connection, although a wired connection could also be used. The game call speaker system 20 can include a buffer memory and temporarily store the sound data received from the mobile device in the buffer memory. In such cases, the system 20 drives the speaker(s) 230 using the data from the buffer. For instance, one or more of the controller 220 and audio processing componentry 225 may access the data from the buffer, process the data, and output the data to the speaker(s) 230 for playback.

The mobile device can include a transceiver which can send data, including game calls, to the game call speaker system 20. The game call speaker system 20 can include a transceiver which can receive data, including game calls, from the mobile device. In some embodiments, the game call speaker system 20 can also send data to the mobile device. In some embodiments, the mobile device can also receive data from the game call speaker system 20. The data may allow for the control and communication between the game call speaker system 20 and the mobile devices (e.g., electronic devices, remotes, memory devices, etc.).

In any of the systems described above, the mobile device can include an internal memory, the game call speaker system 20 can include an internal memory 215, or both the mobile device and the game call speaker system 20 can include an internal memory. In some embodiments, the mobile device can connect to a data source. In some embodiments, the game call speaker system 20 can connect to a data source. The data source can be accessible via a network such as a cellular network or wide area network (WAN) such as the Internet. The connection between the mobile device and the game call speaker system 20 can be wired or wireless. In some other cases where game calls are accessible from a remote location instead of the memory 215, a mobile device is not used, and the game call system 20 or the remote 300 instead include a user interface that allows the user to select desired game calls. The user interacts with such an interface to select a desired game call that is stored at a cloud location or another remote storage location. Upon user selection of the desired game call, the audio data is streamed from the remote location to a wireless interface on the game call speaker system 20 for playback, although a wired connection could be used.

In some embodiments, the game call speaker system 20 can send and/or receive signals, such as wireless signals, radio signals, internet signals, etc. The signals can be of any type known in the art (e.g., wireless, radio, satellite, wi-fi, internet, Bluetooth, etc.). For instance, Bluetooth is wireless technology for exchanging data using short-wavelength UHF radio waves. Wi-Fi is wireless technology that allows an electronic device to exchange data or connect to the internet using UHF and SHF radio waves. Transceivers can be installed in the game call speaker system 20 and one or more mobile devices, which enable control of and communication with the game call speaker system 20. Transceivers would enable the transfer of data, such as sound files or instructions, between the game call speaker system 20 and any associated transceiver. In some embodiments, the mobile device is near the game call speaker system 20 to transmit a signal. In other embodiments, the mobile device is remote from the game call speaker system 20.

In some embodiments, the game call speaker system 20 includes an input device. For instance, the game call speaker system 20 can include an audio input device used to capture sound such as a microphone. The microphone can be located near the user or located at a remote location. The microphone can transmit sounds to be broadcast by the game call speaker system 20 immediately (e.g., in real-time). For instance, the microphone can be placed in an active breeding area to replicate the sounds of the breeding area in the location of the game call speaker system 20. The microphone can be used to record sounds to be stored in the memory 215. For instance, the user can record sounds of animals in protected areas where hunting is prohibited.

The game call speaker system 20 may also comprise a controller 220. The controller 220 may comprise a microcontroller configured to execute software or firmware. The controller 220 may be generally configured to receive inputs from and/or send outputs to other electronic components of the game call speaker system 20. For instance, as shown, the controller 220 can be connected to the power supply 205, the remote interface 210, the audio processing componentry 225 and/or the memory 215.

The game call speaker system 20 may also comprise audio processing componentry 225. The audio processing componentry 225 may include analog componentry (e.g., one or more analog amplifiers, mixers, filters, etc.), digital componentry (e.g., one or more digital mixers, filters, etc.), or both. The audio processing componentry 225 may receive one or more input signals from the controller 220 and generate corresponding drive signals which are sent to the speakers 230 in order to drive the speakers 230 and project sound. The audio processing componentry 225 may be directly or indirectly connected to the controller 220 and to any of the speakers 230. As one example scenario, the user may select a particular sound to output on one or both of the speakers. The user selects the appropriate inputs on the remote control 300, which wirelessly communicates the corresponding control signals to the remote interface 210. The remote interface 210 receives and processes (e.g., digitizes) the incoming signal, and forwards the processed signals as instructions to the controller 220. The controller 220 is configured to process the incoming instructions to access the selected sound profile from the memory 215. The controller 220 generates appropriate output signals to control the audio processing componentry 225, which in turn generates drive signals for driving the speakers 230. In some implementations, there is no separate audio processing componentry 225, and the controller 220 directly connects to and controls the speakers 230.

The game call speaker system 20 can be configured to broadcast any type of audio. For instance, the game call speaker system 20 can broadcast game calls, as described herein. In some embodiments, the game call speaker system 20 can broadcast sounds that mimic the sounds of nature, such as songbirds, crickets, babbling water, etc. In some embodiments, the game call speaker system 20 can broadcast music. In some embodiments, the game call speaker system 20 can broadcast warning signals. For instance, the game call speaker system 20 broadcast a siren to discourage trespassers.

In some embodiments, additional components, besides those listed, may be present in the game call speaker system 20. In addition, even though all of the components may be present, they may be connected in a different way or have other components disposed between the ones listed.

Example Use Cases

The game call speaker system 10 can be configured to play a pattern of sounds. The pattern of sounds can be correlated with movement from the speaker units 135*a*, 135*b*. For example, the first speaker unit 135*a* can point north and play a first call (e.g., a coyote call). After a time delay, the first speaker unit 135*a* point northeast and play a second call (e.g., a different coyote call). In some embodiments, the first speaker unit 135*a* will have a series of movements that corresponds to a series of calls. For instance, referring to FIG. 6, the pattern of sounds and/or the corresponding pattern of movement can be stored in the memory 215, and the controller 220 can access the appropriate pattern(s), e.g., in response to user selection of an appropriate mode of operation.

In some embodiments, the first speaker unit 135*a* can be configured for random or pseudorandom movement and/or to output randomly selected or pseudorandomly selected types of calls. For instance, the speaker system 10 may implement operational modes that allow a user to select (e.g., via the remote 300 and/or the user interface 115) one or more of a random movement mode, a random sound mode, and a combination thereof. In some implementations, the controller 220 implements a pseudorandom number generator and employs the pseudorandom number generator to generate the random or pseudorandom patterns in the random movement and/or random sound modes.

As one example, a user selects a random movement mode using the remote control 300. The remote interface 210 of the system 20 receives a corresponding command from the remote. The controller 220 processes the command and generates a random or pseudorandom motor control sequence using a pseudorandom number generator. The motor control sequence is forwarded to the motor(s) 235, which cause rotation of the corresponding speakers 230 according to the sequence. For example, the speakers 230 may periodically change direction of rotation at random or pseudorandom intervals. In some cases, the speed of rotation can also vary in a random or pseudorandom fashion according to the generated sequence.

In another example, a user selects a pseudorandom sound mode user the remote 300. The remote interface 210 wirelessly receives the corresponding command, which is forwarded to the controller 220 for processing, which in turn generates a random or pseudorandom sequence for accessing different game calls. Based on the generated sequence, the controller 220 randomly or pseudorandomly selects different game calls from the memory 215. Depending on the implementation, the controller 220 may change between selected game calls at pre-determined or user selected intervals (e.g., every 1, 5, or 10 minutes), or may change between game calls at randomly or pseudorandomly selected intervals.

In some embodiments, the pattern of sounds can correspond to patterns mimicking behavior of animals. For instance, the first speaker unit 135*a* can emit a call and the second speaker unit can emit a response. The speaker units 135*a*, 135*b* can move in relation to each other to mimic two animals moving toward each other. For instance, the first speaker unit 135*a* can emit a call of a young animal and the second speaker unit can emit a call of a parent. The speaker units 135*a*, 135*b* can be moved in synchrony to mimic two animals near each other.

As indicated, the game call speaker system 10 may be used by hunters and other outdoorsmen. The body 100 may be positioned in a first location where the user desires the sounds to be emitted. The body 100 may be placed on the ground and therefore supported by the base 105. The body 100 can be suspended by use of the loops 120 (e.g., from a tree or other structure). In some embodiments, the body 100 may be deployed on the ground or other structure near the ground. In some methods of use, the user may interact with the user interface 115 to change a parameter of the game call speaker system 10. For instance, the user may position the speaker units 135*a*, 135*b* or turn the game call speaker system 10 on. The user may select the animal call or the volume of the speaker units 135*a*, 135*b*.

In some methods of use, the user may be positioned in a different location than the game call speaker system 10. For instance, the user may be concealed from the view of the animals. In some methods of use, the user may interact with the remote control 300 to change a parameter of the game call speaker system 10. For instance, the user may wish to change the direction of the speaker units 135*a*, 135*b* in order to change the direction at which the sounds are projected. In this case, it may be advantageous for the user to be able to use the remote control 300 to change the direction of one or more of the speaker units 135*a*, 135*b*. The remote control 300 allows the user to change this parameter from a remote location and remain concealed. The user does not need to physically interact with the game call speaker system 10 (e.g., no need to physically change the direction of the speakers or interact with the user interface 115).

In some instances, it may be advantageous for the body 100 to be suspended in the air. In this case, a rope or other support may be attached to part of the body 100, which may include one or more loops 120. In some instances, it may be desirable for the body 100 to be suspended in the air between two structures, such as trees. In this case, a first rope may be attached to a first loop 120 and a second rope may be attached to a second loop 120. The first rope may be attached to or engaged with a first tree and the second rope may be attached to or engaged with a second tree. The body 100 may then be suspended between the first and second trees. If the body 100 is suspended between two trees in such a fashion, the direction that the speaker units 135*a*, 135*b* are facing when initially suspended may not be the direction that the user desires that they point. For instance, the user may desire that the sound from the body 100 is directed in a particular direction based on information gathered after the game call speaker system 10 was suspended. In this instance, the user may use the remote control 300 to change the direction of one or more speaker units 135*a*, 135*b* in order to customize the direction in which the sounds are projected.

In some embodiments, the user may be able to choose from dozens, hundreds, or thousands of different sounds to be projected by the speaker units 135*a*, 135*b*. The first speaker unit 135*a* and the second speaker unit 135*b* may be configured to project the same sounds at the same time. The first speaker unit 135*a* may additionally be configured to project a different sound from the second speaker unit 135*b*. In some embodiments, the second speaker unit 135*b* may play the same sound as the first speaker unit 135*a*, but delayed, giving the impression that there are more animals present. Or, the second speaker unit 135*b* may be configured to play an entirely different animal sound. In some embodiments, multiple different sounds are mixed together for transmission via a single output stream from the same speaker unit. In such embodiments, the resulting audio can give the effect of the sounds being emitted simultaneously. The game call speaker system 10 may further or alternatively be configured to automatically alternate between outputting the different sounds (e.g., every second, every 2, 3, 4, or 5 seconds, or every 10, 20, 50, 100, 500 milliseconds or some other fraction of a second).

In some instances, it may be desirable for a hunter to have a first animal sound played in a first direction and a second animal sound played in a second direction. Therefore, it may be advantageous for the game call speaker system 10 to be configured such that the first speaker unit 135*a* and the second speaker unit 135*b* can be rotationally adjusted independent from one another. For instance, a hunter may be aware that a first type of game is likely to be present in an area South of the game call unit, and that a second type of game are likely to be present in an area North of the unit. The user can control a first South-facing speaker 135*a* to output a first type of sound and rotate through different South-facing directions to probe for the first type of game, and similarly direct a second North-facing speaker 135*b* to output a second type of sound and rotate through different North-facing directions to probe for the second type of game. Furthermore, since the body 100 may not always be easily accessible, such as when the body 100 is suspended between two trees, it may be advantageous for the first and second speaker units 135*a*, 135*b*, to be rotationally adjusted independently from one another and also adjusted from a distance.

Example Numbered Embodiments

The following is a listing of example numbered embodiments intended to illustrate various features disclosed herein. It is to be understood that these numbered embodiments are not intended to limit the scope of the disclosure, but rather to provide examples of some exemplary combinations of features.

1. A portable sound generating device comprising:
   a body portion;
   at least one speaker unit connected to the body portion, at least one speaker unit having a primary audio axis; and
   audio electronics configured to electrically drive the at least one speaker unit thereby causing the at least one speaker unit to emit sound.

2. A device according to any of the listed embodiments, further comprising a control unit operably coupled to the at least one speaker unit, the control unit configured to respond to commands to adjust a pointing direction of the primary audio axis.

3. A device according to any of the listed embodiments, further comprising a remote interface in electronic communication with a remote control, the remote control having an input interface allowing the user to enter commands for operating the device.

4. A device according to any of the listed embodiments, wherein the remote interface is a wireless interface.

5. A device according to any of the listed embodiments, wherein the speaker unit is configured to rotate about a substantially vertical axis during the adjustment of the pointing direction.

6. A device according to any of the listed embodiments, wherein the control unit comprises at least one motor configured to effect the adjustment of the pointing direction.

7. A device according to any of the listed embodiments, wherein the at least one speaker unit is independently movable with respect to the body portion.

8. A device according to any of the listed embodiments, wherein the at least one speaker unit comprises a first speaker unit and a second speaker unit.

9. A device according to any of the listed embodiments, wherein the first speaker unit is positioned at a first end of the body portion and the second speaker is position at a second end of the body portion.

10. A device according to any of the listed embodiments, wherein adjustment of the pointing direction of the primary audio axis includes rotation of the primary audio axis about a substantially vertical axis, the primary audio axis substantially perpendicular to the vertical axis.

11. A device according to any of the listed embodiments, wherein each of the at least one speaker unit is rotatable such that the primary audio axis can move within an angular range of at least about 90 degrees.

12. A device according to any of the listed embodiments, wherein each of the at least one speaker unit is rotatable such that the primary audio axis can move within an angular range of at least about 120 degrees.

13. A device according to any of the listed embodiments, wherein each of the at least one speaker unit is rotatable such that the primary audio axis can move within an angular range of at least about 150 degrees.

14. A device according to any of the listed embodiments, wherein each of the at least one speaker unit is rotatable such that the primary audio axis can move within an angular range of at least about 180 degrees.

15. A device according to any of the listed embodiments, wherein the primary audio axis of the at least one speaker unit can be adjusted to point in a set of possible pointing directions spanning an angular range of about 360 degrees.

16. A device according to any of the listed embodiments, wherein the at least one speaker unit comprises at least two speaker units, and the combined set of possible pointing directions for the primary audio axes of the at least two speaker units spans an angular range of about 360 degrees.

17. A device according to any of the listed embodiments, wherein the primary audio axis of the at least one speaker unit can be adjusted to point in a set of possible pointing directions spanning an angular range of at least about 270, at least about 300, or at least about 330 degrees, depending on the embodiment.

18. A device according to any of the listed embodiments, wherein the at least one speaker unit comprises at least two speaker units, and the combined set of possible pointing directions for the primary audio axes of the at least two speaker units spans an angular range of at least about 270, at least about 300, or at least about 330 degrees, depending on the embodiment.

19. A device according to any of the listed embodiments, further comprising at least one memory device storing one or more game calls.

20. A device according to any of the listed embodiments, wherein the one or more game calls comprise a plurality of different game calls.

21. A device according to any of the listed embodiments, further comprising an audio processor in communication with the memory, responsive to commands received over the remote interface to access a selected game call from the memory device, and to drive the at least one speaker unit with the accessed game call.

22. A device according to any of the listed embodiments, wherein the audio processor is configured in at least one operational mode of the device to drive the first speaker unit with a first game call accessed from the memory and to drive the second speaker unit with a second game call accessed from the memory.

23. A device according to any of the listed embodiments, wherein the audio processor is configured in the at least one operational mode to drive the first speaker unit with the first game call and the second speaker unit with the second game call simultaneously, substantially simultaneously, or in an alternating fashion, depending on the embodiment.

24. A device according to any of the listed embodiments, wherein the audio processor is configured in at least one operational mode to access multiple game calls, and to drive a same one of the at least one speaker units with the multiple game calls.

25. A device according to any of the listed embodiments, wherein the audio processor is configured in at least one operational mode to access multiple game calls, and to drive a same one of the at least one speaker units with the multiple game calls substantially simultaneously, simultaneously, or in an alternating fashion, depending on the embodiment.

26. A device according to any of the listed embodiments, further comprising a power supply contained within the body portion.

Terminology; Additional Embodiments

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the inventions and without diminishing the attendant advantages. For instance, various components may be repositioned as desired. It is therefore intended that such changes and modifications be included within the scope of the inventions. Moreover, not all of the features, aspects and advantages are necessarily required to practice the present inventions. Accordingly, the scope of the present invention is intended to be defined only by the claims that follow.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Conjunctions, such as "and," "or" are used interchangeably and are intended to encompass any one element, combination, or entirety of elements to which the conjunction refers.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially.

Systems and modules described herein may comprise software, firmware, hardware, or any combination(s) of software, firmware, or hardware suitable for the purposes described herein. Various disclosed and illustrated modules may be implemented as software and/or firmware on a logic circuitry, processor, ASIC/FPGA, or dedicated hardware. Software and other modules may reside on servers, workstations, personal computers, computerized tablets, PDAs, and other devices suitable for the purposes described herein. Software and other modules may be accessible via local memory, via a network, via a browser, or via other means suitable for the purposes described herein. User interface components described herein may comprise buttons, knobs, switches, touchscreen interfaces, and other suitable interfaces.

Further, the processing of the various components of the illustrated systems can be distributed across multiple logic circuits, processors, machines, networks, and other computing resources. In addition, two or more components of a system can be combined into fewer components. Various components of the illustrated systems can be implemented in one or more virtual machines, rather than in dedicated computer hardware systems. Moreover, in some embodiments the connections between the components shown represent possible paths of data flow, rather than actual connections between hardware. While some examples of possible connections are shown, any of the subset of the components shown can communicate with any other subset of components in various implementations.

Embodiments are also described above with reference to flow chart illustrations and/or block diagrams of methods, apparatus (systems) and computer program products. The actual steps taken in the disclosed processes may differ from those disclosed or illustrated. Depending on the embodiment, certain of the steps described above may be removed, others may be added. In addition, each block of the flow chart illustrations and/or block diagrams, and combinations of blocks in the flow chart illustrations and/or block diagrams, may be implemented by computer program instructions. Such instructions may be provided to a processor of a general purpose computer, special purpose computer, or other programmable data processing apparatus to produce a machine, such that the instructions, which execute via the processor of the computer or other programmable data processing apparatus, create means for implementing the acts specified in the flow chart and/or block diagram block or blocks.

These computer program instructions may also be stored in a computer-readable memory that can direct a computer or other programmable data processing apparatus to operate in a particular manner, such that the instructions stored in the computer-readable memory produce an article of manufacture including instruction means which implement the acts specified in the flow chart and/or block diagram block or blocks. The computer program instructions may also be loaded onto a computer or other programmable data processing apparatus to cause a series of operations to be performed on the computer or other programmable apparatus to produce a computer implemented process such that the instructions which execute on the computer or other programmable apparatus provide steps for implementing the acts specified in the flow chart and/or block diagram block or blocks.

What is claimed is:

1. A game call speaker system comprising:

a body portion having a bottom portion;

first and second electric motors;

a first speaker unit comprising a first speaker and coupled to the first electric motor, wherein the first speaker unit is configured to rotate relative to the body portion under control of the first motor over a range of motion spanning greater than 90 degrees about a first axis;

a second speaker unit comprising a second speaker and coupled to the second electric motor, wherein the second speaker unit is configured to rotate relative to the body portion under control of the second motor over a range of motion spanning an angle greater than 90 degrees about a second axis, wherein rotation of the first speaker unit is independent of rotation of the second speaker unit, wherein the first axis is substantially parallel to the second axis, wherein the first and second speaker units are configured to rotate while emitting sound;

a memory comprising one or more stored game calls; and a remote interface configured to wirelessly receive commands from a remote control.

2. The game call speaker system of claim 1, further comprising audio electronics configured to electrically control the first speaker unit and the second speaker unit.

3. The game call speaker system of claim 1, further comprising a control unit operably coupled to the first speaker unit and the second speaker unit, the control unit configured to respond to commands to independently rotate the first speaker unit and the second speaker unit.

4. The game call speaker system of claim 1, further comprising an interface allowing the user to enter commands for operating the game call speaker system.

5. The game call speaker system of claim 1, wherein the first speaker unit is positioned at a first end of the body portion and the second speaker unit is position at a second end of the body portion.

6. The game call speaker system of claim 1, further comprising an audio processor in communication with the memory and responsive to commands to access a selected game call from the memory and to drive at least one speaker unit to audibly output selected game call.

7. The game call speaker system of claim 1, wherein the audio processor is configured in at least one operational mode to drive the first speaker unit to audibly output a first game call accessed from the memory and to drive the second speaker unit to audibly output a second game call accessed from the memory.

8. The game call speaker system of claim 7, wherein the audio processor is configured in the at least one operational mode to drive the first speaker unit to audibly output the first game call and to drive the second speaker unit to audibly output the second game call simultaneously.

9. A game call speaker system comprising:

a body portion having a bottom portion;

first and second electric motors;

a first speaker unit comprising a first speaker and coupled to the first electric motor, wherein the first speaker unit is configured to rotate relative to the body portion under control of the first motor over a range of motion spanning approximately 180 degrees about the first axis;

a second speaker unit comprising a second speaker and coupled to the second electric motor, wherein the second speaker unit is configured to rotate relative to the body portion under control of the second motor over a range of motion spanning an angle of approximately 180 degrees about the second axis, wherein the first axis is substantially parallel to the second axis, wherein the first and second speaker units are configured to rotate while emitting sound; and a memory comprising one or more stored game calls, wherein the first and second speaker units can be selectively controlled to emit the stored game calls in substantially 360 degrees relative to the body portion.

10. The game call speaker system of claim 9, further comprising a remote interface configured to wirelessly receive commands from a remote control.

11. A game call speaker system comprising:

a body portion having a bottom portion;

first and second electric motors;

a first speaker unit comprising a first speaker and coupled to the first electric motor, wherein the first speaker unit is configured to rotate relative to the body portion under control of the first motor over a range of motion spanning greater than 90 degrees about a first axis, wherein the first axis is a substantially vertical axis along the height of the game call speaker system;

a second speaker unit comprising a second speaker and coupled to the second electric motor, wherein the second speaker unit is configured to rotate relative to the body portion under control of the second motor over a range of motion spanning an angle greater than 90 degrees about a second axis, wherein rotation of the first speaker unit is independent of rotation of the second speaker unit, wherein the first axis is substantially parallel to the second axis, wherein the first and second speaker units are configured to rotate while emitting sound; and a memory comprising one or more stored game calls.

12. The game call speaker system of claim 11, wherein the second axis is a substantially vertical axis along the height of the game call speaker system.

13. A method of using a game call speaker system comprising:

with a first powered motor, rotating a first speaker unit of the game call speaker system about a first axis while emitting sounds from the first speaker unit;

with a second powered motor, rotating a second speaker unit of the game call speaker system about a second axis, wherein rotation of the first speaker unit is independent of rotation of the second speaker unit; and accessing a memory comprising one or more stored game calls;

audibly outputting one of the stored game calls using the first speaker unit; and audibly outputting one of the stored game calls using the second speaker unit, wherein the first and second speaker units are configured to rotate while emitting sound.

14. The method of claim 13, further comprising controlling the rotation of the first speaker unit and the second speaker unit with a remote control.

15. The method of claim 13, wherein said rotating the second speaker unit of the game call speaker system about the second axis comprises rotating the second speaker unit about the second axis while emitting sounds from the second speaker unit.

16. The method of claim 13, wherein said rotating the first speaker unit comprises rotating the first speaker unit such that a pointing axis of the first speaker unit swings along an angle spanning at least about 90 degrees.

17. A game call speaker system comprising:

a body portion having a bottom portion;

first and second electric motors;

a first speaker unit comprising a first speaker and coupled to the first electric motor, wherein the first speaker unit is configured to rotate relative to the body portion under control of the first motor over a range of motion spanning greater than 90 degrees about a first axis, wherein the first axis is a substantially vertical axis along the height of the game call speaker system;

a second speaker unit comprising a second speaker and coupled to the second electric motor, wherein the second speaker unit is configured to rotate relative to the body portion of motion spanning an angle greater than 90 degrees about a second axis, wherein rotation of the first speaker unit is independent of rotation of the second speaker unit, wherein the first axis is substantially parallel to the second axis; and a remote interface configured to wirelessly receive commands from a remote control.

* * * * *